US006244452B1

(12) United States Patent
Morano et al.

(10) Patent No.: US 6,244,452 B1
(45) **Date of Patent: *Jun. 12, 2001**

(54) HOLDER FOR USE IN DISPOSABLE FEEDING SYSTEMS

(75) Inventors: Emanual Peter Morano, Totowa; Robert W. Shaw, Piscataway, both of NJ (US); Paul Dowd, Bronxville, NY (US); Lorena S. Telofski, Plainsboro; Alan G. Trojanowski, Monmouth Junction, both of NJ (US)

(73) Assignee: Johnson & Johnson Consumer Companies, Inc., Skillman, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/225,793

(22) Filed: Jan. 5, 1999

Related U.S. Application Data

(63) Continuation-in-part of application No. 08/896,187, filed on Jul. 17, 1997, now Pat. No. 6,092,681.

(51) Int. Cl.[7] ..... A61J 9/00

(52) U.S. Cl. ..... 215/11.6; 220/4.21; 220/4.26; 215/11.1; 215/11.3

(58) Field of Search ..... 215/11.1, 11.3; 220/4.21, 4.26, 4.27

(56) References Cited

U.S. PATENT DOCUMENTS

| | | |
|---|---|---|
| D. 138,925 | 9/1944 | Ostrin et al. . |
| D. 371,849 | 7/1996 | Thom . |
| D. 376,430 | 12/1996 | Humphrey et al. . |
| 1,319,297 | 10/1919 | Limacher . |
| 3,061,129 | 10/1962 | FitzGerald . |
| 3,071,272 | 1/1963 | Doner . |

(List continued on next page.)

FOREIGN PATENT DOCUMENTS

| | | |
|---|---|---|
| 0 061 868 A1 | 10/1982 | (EP) . |
| 0 414 67381 | 3/1994 | (EP) . |
| 0 891 762 A2 | 7/1998 | (EP) . |
| 2 109 247 | 11/1981 | (GB) . |
| 2 109 247 | 6/1983 | (UA) . |
| 2 277 452A | 11/1994 | (UA) . |
| WO 91/03225 | 3/1991 | (WO) . |
| WO 92/01435 | 2/1992 | (WO) . |
| WO 92/14437 | 9/1992 | (WO) . |

*Primary Examiner*—Stephen P. Garbe
*Assistant Examiner*—Tri M. Mai
(74) *Attorney, Agent, or Firm*—Michele G. Mangini

(57) ABSTRACT

A holder for use in disposable feeding systems includes a body which is made from two straight pieces or sections capable of being arranged in an abutting, end-to-end relationship in which they assume a non-coaxial arrangement that results in an angular body shape designed, for instance, to promote infant feeding in a semi-upright position. From this feeding position, the body sections of a transformable embodiment can be moved to a filling position, in which they are arranged coaxially to form a straight body shape that facilitates the insertion and/or filling of a disposable liner, preferably via movement of a friction fit mechanism. The body sections of both the transformable and non-transformable embodiments may also be provided with finger guides, which promote the proper gripping of the holder by a user, and finger holes, which facilitate the expulsion of air from a liquid-filled liner receivable in an interior of the holder.

7 Claims, 16 Drawing Sheets

U.S. PATENT DOCUMENTS

| | | | | |
|---|---|---|---|---|
| 3,145,867 | | 8/1964 | Roberts et al. . | |
| 3,762,542 | | 10/1973 | Grimes . | |
| 3,770,154 | * | 11/1973 | Johnson | 215/11.4 |
| 4,676,387 | | 6/1987 | Stephenson et al. . | |
| 4,703,863 | | 11/1987 | Kohus . | |
| 4,813,556 | | 3/1989 | Lawrence . | |
| 4,925,042 | | 5/1990 | Chong . | |
| 4,944,418 | | 7/1990 | Wallace . | |
| 5,275,298 | | 1/1994 | Holley, Jr. et al. . | |
| 5,361,918 | | 11/1994 | Mason . | |
| 5,509,549 | | 4/1996 | Marandola . | |
| 5,540,341 | | 7/1996 | Holley et al. . | |
| 5,551,583 | | 9/1996 | Sachathamakul et al. . | |
| 5,588,548 | * | 12/1996 | Brankley | 215/11.1 X |
| 5,693,033 | | 12/1997 | Nita . | |
| 5,699,920 | * | 12/1997 | Ida et al. | 215/11.3 |

* cited by examiner

HOLDER FOR USE IN DISPOSABLE FEEDING SYSTEMS

CROSS REFERENCE TO RELATED APPLICATION

This application is a continued prosecution application of U.S. Ser. No. 09/225,793 filed on Jan. 5, 1999, which is a continuation in part of U.S. application Ser. No. 08/896,187 (Attorney Docket No. JBP-378) filed on Jul. 17, 1997, which is incorporated by reference in its entirety herein now U.S. Pat. No. 6,092,681.

FIELD OF THE INVENTION

The present invention relates to disposable feeding systems, and, more particularly, to a holder for use in such systems, especially those adapted for use by infants.

BACKGROUND OF THE INVENTION

Due largely to the inconvenience associated with the need to wash and/or sterilize conventional, reusable, nurser bottles (i.e., nurser bottles having a body which comes into direct contact with milk or some other liquid nutriment), infant feeding systems have been developed that make use of a presterilized and disposable liner, which is removably supported within a tubular holder (see, for instance, U.S. Pat. No. 3,762,542). At the conclusion of a feeding session, the used liner can be removed from the holder and replaced with a new liner. Because the milk or other liquid nutriment never comes into contact with the holder itself, there is no need to wash and/or sterilize the holder before it is reused. Accordingly, liner-type or disposable infant feeding systems have become very popular in today's mobile society in which the feeding of infants often takes place in vehicles or in other places where washing and/or sterilization facilities may not be readily available.

Over the years, the infant feeding field has recognized and developed numerous additional convenience features for infant feeding systems in general. For instance, it has been long recognized that infants should be fed in an upright or semi-upright position (see, for example, U.S. Pat. No. 3,145,867). The American Academy of Pediatrics has, in fact, recommended that infants be fed in a semi-upright position.

The aforementioned U.S. Pat. No. 3,145,867 discloses a baby bottle having a rigid body which is angled or bent to promote the feeding of a baby in the desired upright or semi-upright position. This patent also recognizes that the baby bottle disclosed therein can be equipped with grips designed to insure that the bottle is properly positioned relative to the user and the baby. Such angled or bent baby bottles are not, however, adapted for use in a liner-type feeding system because they do not include means, such as access openings, for permitting air to be expelled from an associated liner as is customary with liner-type feeding systems (see, for example, the aforementioned U.S. Pat. No. 3,762,542).

In the past, efforts have been made to provide liner-type feeding systems with the ability to be arranged in a substantially linear or straight position, which facilitates the insertion and/or filling of the associated liner, and then bent into an angled position, which promotes the feeding of an infant in the desired upright or semi-upright position (see, for instance, U.S. Pat. No. 4,813,556 and British Patent Publication No. 2 109 247 A). As presently understood, these efforts involve the use of bellows to achieve the flexibility required to permit the bottles or holders to be bent between the two positions described above. The use of bellows is, however, disadvantageous for a number of reasons. First, because the bellows create a number of crevices and accordion-like pleats in the internal and external surfaces of the bottles and holders that employ them, cleaning of the bottles and holders is complicated. Second, the bellows also deter the provision of the grips which, as described above, are designed to ensure that the bottle or holder is properly positioned relative to the user and the infant. Third, when used in conjunction with a holder of a liner-type feeding system, the bellows offer a potential pinch point for the liner. Last, but not least, the bellows are plainly visible; and, as such, they detract from the overall aesthetic appearance of the bottles or holders that employ them.

In the foregoing circumstances, it is an objective of the present invention to provide a disposable feeding system which combines the convenience features of conventional disposable feeding systems with other features that have proven to be advantageous in this field, such as the ability to promote a user to feed an infant in a semi-upright position and the ability to expel air from the system throughout the feeding process. Another objective is to provide an ergonomic feeding benefit to the person (e.g., nurser) who uses the present invention. These and other objectives will be apparent from the following description of the present invention.

SUMMARY OF THE INVENTION

The problems and shortcomings of the prior art discussed above are overcome by the present invention, which relates to a new and improved holder for use in disposable feeding systems. Briefly, the holder includes a first rigid body section, having a longitudinal axis and a pair of open ends, and a second rigid body section, having a longitudinal axis and a pair of open ends. The body sections are connected in end-to-end fashion such that they are movable relative to each other between a first position, in which their longitudinal axes are in substantial coaxial alignment with each other, and a second position, in which their longitudinal axes are substantially out of coaxial alignment with each other and in which their interconnected ends are in an abutting relationship with each other. In the first position, the holder is substantially straight to thereby facilitate the insertion and/or filling of a removable liner. In the second position, the holder is bent to an extent which promotes the feeding of an infant in a semi-upright position. Detents may be provided for releasably retaining the holder in either or both positions.

In one embodiment, the body sections are snap fitted together, with their interconnected ends being slidably and rotatably engaged to permit the quick and easy transformation of the holder from its straight, or upright, position to its bent, or angled, position and vice versa. The use of a snap-fit type of connection is beneficial because it is hidden from a user's view and, as a result, does not detract from the overall aesthetic appearance of the holder. Inasmuch as a snap-fit type of connection does not consume a lot of space, it allows the holder to be provided with access openings, in both of the body sections, as well as with finger grips or guides. It also provides a preferred engagement which orients the holder in a position such that an infant can be naturally fed in the recommended semi-upright feeding position and, as such, the person feeding the infant will be doing this in an ergonomically correct position.

In other embodiments, the body sections are pivotally connected, frictionally connected, or rigidly connected to each other. The pivotal connection can be accomplished by, for example, a living hinge or a ball and socket type of joint. When the body sections are connected in a rigid manner or by way of a living hinge, they form a holder having a one-piece or unitary body, as compared with the two-piece bodies of the other embodiments. The frictional connection can be accomplished by, for example, interacting ramping lugs and friction lugs.

BRIEF DESCRIPTION OF THE DRAWINGS

For a better understanding of the present invention, reference is made to the following description of various exemplary embodiments, considered in conjunction with the accompanying drawings, in which.

DESCRIPTION OF THE EXEMPLARY EMBODIMENTS

Although the present invention has utility as a holder for use in disposable (i.e., liner-type) feeding systems in general, it is especially suited for use in disposable infant feeding nurser systems. Accordingly, the present invention will be described hereinafter in conjunction with a disposable feeding system for infants, it being understood that the invention may also be employed in disposable feeding systems adapted for use by older children, adults, invalids and the like.

Figure 1:
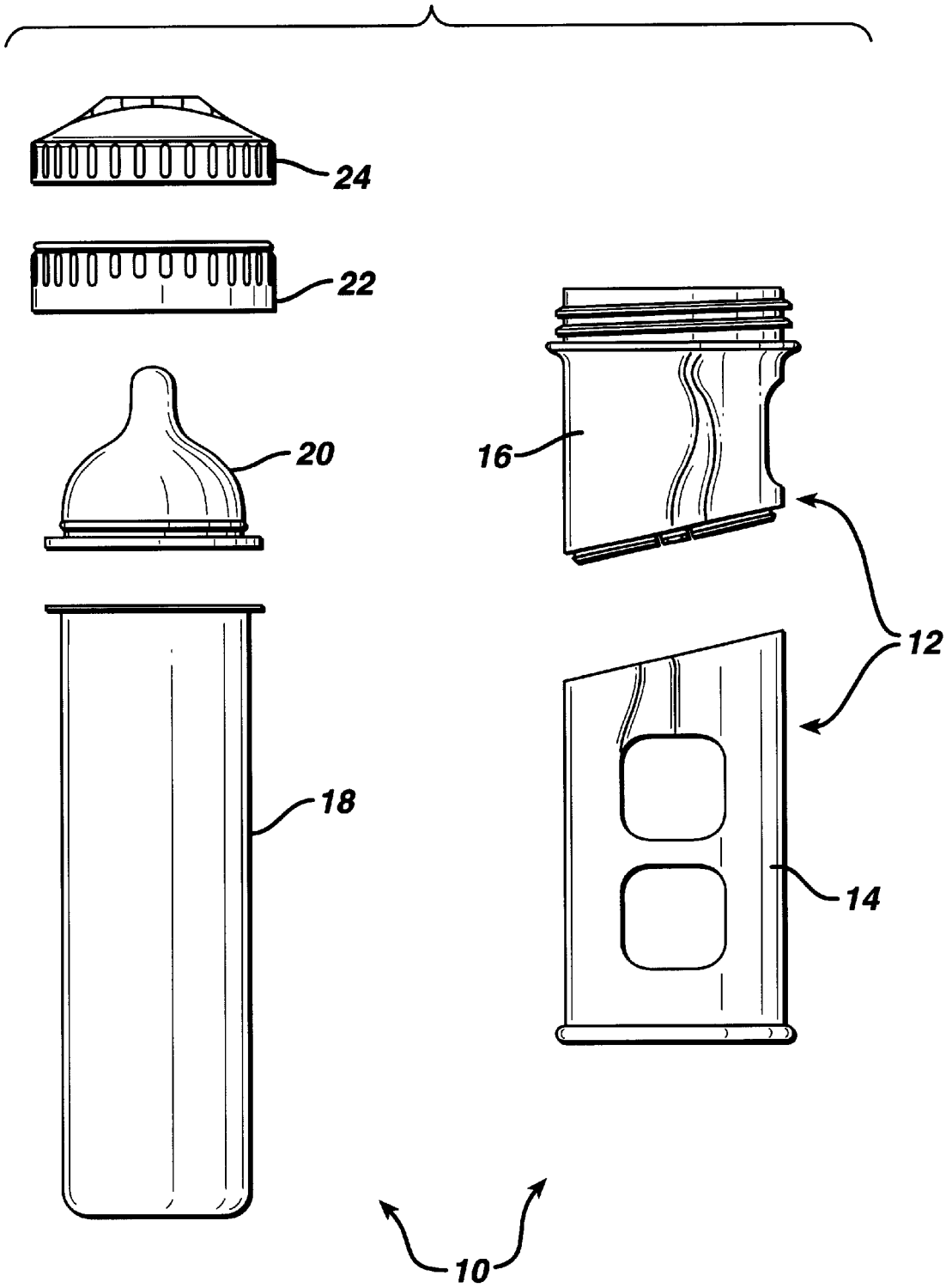
FIG. 1 is an exploded view of a disposable infant feeding nurser system which includes a holder constructed in accordance with a first exemplary embodiment of the present invention.

Referring to FIG. 1, a disposable infant feeding nurser system 10 includes the following components: a two-piece holder 12 made from a base section 14 and a neck section 16; a disposable liner 18; a nipple 20; a collar 22; and a protective cap 24. Because the liner 18, nipple 20, collar 22 and cap 24 are all conventional in the infant feeding field, they will not be described in detail hereinafter. The holder 12, however, represents a novel improvement in this field; and, therefore, the following discussion will focus on the construction and operation of the holder 12, including its relationship to the other components of the nurser system 10.

With reference to FIGS. 2–7, the base section 14 of the holder 12 has a tubular body 26 which is preferably injection molded from a clear, translucent or colored plastic, such as polycarbonate or clarified polypropylene, a premixture of an olefin plastic (e.g. polypropylene) with a rubber (e.g., those available under the tradename "KRATON"), rubber alone, or any other suitable material known to those skilled in the art. The body 26 could be in the form of a bi-component or multi-component part made from more than one material, such as a combination of a polymer and a rubber. Such parts are conventionally manufactured by co-extrusion, co-molding, co-injection or other suitable technologies, such as an insert molding process, that incorporate the use of materials of different types and properties (see, for instance, U.S. Pat. No. 5,544,766). Alternatively, the body 26 could be made from glass.

The base section 14 of the holder 12 need not always be comprised of the same material as that comprising the neck section 16. In a preferred embodiment, the base section 14 is comprised of a material having a greater flexibility than polycarbonate, i.e. olefins have a flexural modulus of less than about $3.5\times10^4$ psi, and preferably less than about $0.50\times10^4$ psi[1]. Examples of such materials include polypropylene, polyethylene or any other thermoplastic elastomers, and mixtures and copolymers thereof.

The length of the base section 14 and the neck section 16 need not be equivalent but rather may vary depending upon the desired use. In one embodiment shown in FIG. 36, the length of the base section 14 may be elongated relative to the length of neck section 16, with the length of the neck section being as small as about ¼ inch. When a flexible material, i.e. a material having a flexural modulus of less than about $0.5\times10^3$, is used as the material for the base section 14 in this embodiment, the user is able to simultaneously squeeze the exterior walls of the base section 14 along with the exterior walls of the liner 18 contained therein for purposes of removing any air that was trapped within the liner 18. Examples of suitable flexible materials include, but are not limited to natural and synthetic rubbers.

Figure 5:
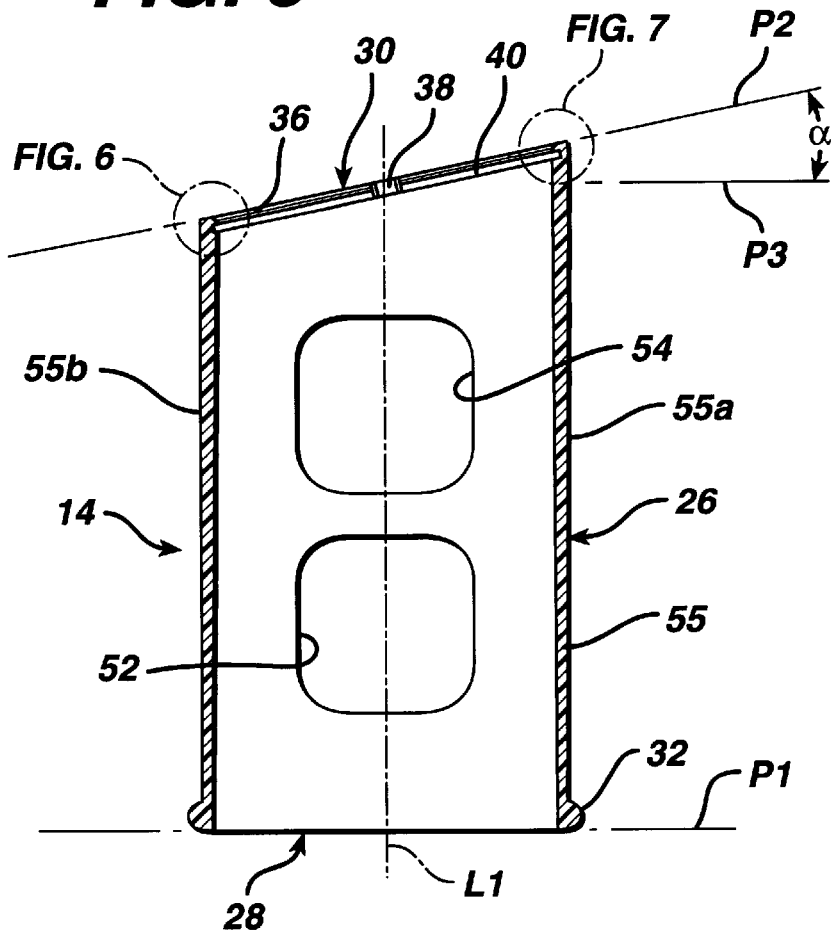
FIG. 5 is a cross-sectional view, taken along section line V—V of FIG. 4 and looking in the direction of the arrows, of the body section illustrated in FIG. 4.
Figure 6:
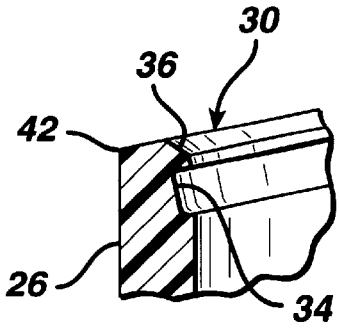
FIG. 6 is a detailed view, in an enlarged scale, of a portion of the body section illustrated in FIG. 5.
Figure 7:
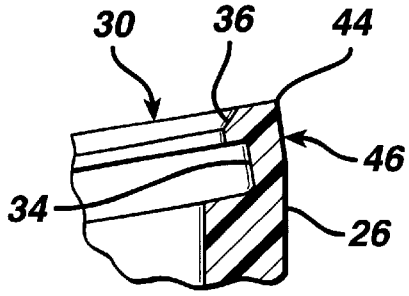
FIG. 7 is a detailed view, in an enlarged scale, of another portion of the body section illustrated in FIG. 5.

The body 26, which has a truncated cylindrical shape, is hollow and terminates in a pair of open ends 28, 30. With particular reference to FIG. 5, the untruncated end 28 lies in an imaginary plane P1 which is normal to a longitudinal axis L1 of the base section 14, while the truncated end 30 lies in an imaginary plane P2, which is arranged at an angle $\alpha$ relative to an imaginary plane P3 parallel to the plane P1 and containing the point of intersection between the longitudinal axis L1 and the plane P2. In theory, the angle $\alpha$ should be greater than 0° but less than 45°. In practice, the angle $\alpha$ is preferably about 12.5°, but can be anywhere in a preferred range of from about 5° to about 15° or in a more preferred range of from about 10° to about 15°. The significance of and the criteria for selecting the angle $\alpha$ will be discussed hereinafter.

The untruncated end 28 of the base section 14 is provided with a rounded annular bead 32 designed to eliminate sharp edges, which might injure an infant or user. The bead 32 also enhances the stability of the holder 12 when it is placed on a supporting surface, such as a table top or a counter top (not shown).

The truncated end 30 of the base section 14 is provided with an internal, circular groove 34, whose function will be described hereinafter. A chamfer 36 (see FIGS. 5–7) functions as a lead-in to the groove 34 for a purpose to be described hereinafter. In a preferred embodiment, the truncated end 30 of the body 26 also includes a pair of slots 38, 40 (see FIG. 4) whose function will be described hereinafter. In a is preferred embodiment, the slots 38, 40 extend longitudinally from the truncated end 30 of the body 26 to the groove 34 along opposite sides of the base section 14 (see FIG. 5), it being understood that the number and location of the slots 38, 40 can be varied as will be explained hereinafter. It should also be understood that the dimensions of the groove 34 and the slots 38,40 may be varied.

Due to the angle $\alpha$, the truncated end 30 of the body 26 has a point 42 (see FIGS. 2 and 6), which is nearest to the untruncated end 28 of the body 26, and a point 44 (see FIGS. 2 and 7), which is farthest from the untruncated end 28 of the body 26. Also, the truncated end 30 of the body 26 has a slightly curved region 46 (see FIGS. 2 and 7) which extends around the body 26 in a generally semi-circular fashion toward the point 42 for a reason to be discussed hereinafter.

Figure 2:
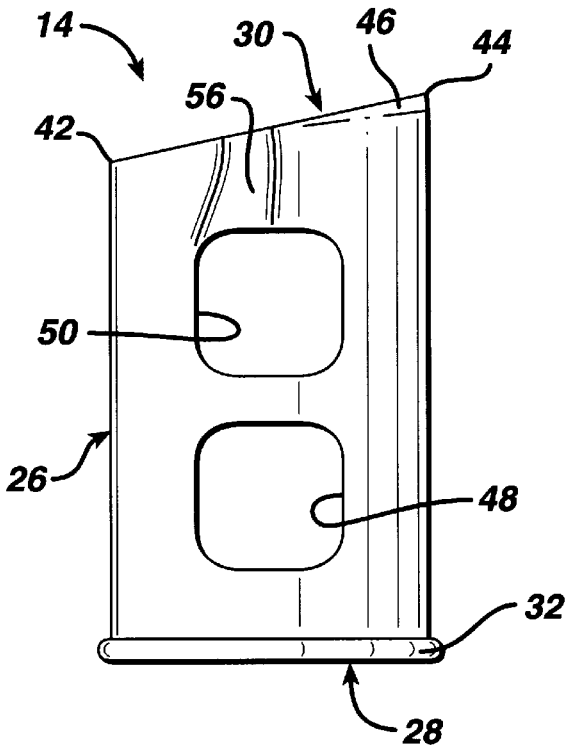
FIG. 2 is a side elevational view, in an enlarged scale, of one of the two body sections which form the holder illustrated in FIG. 1.

A pair of circumferentially aligned openings 48, 50 is provided on one side of the body 26 (see FIG. 2). Another pair of circumferentially aligned openings 52, 54 is provided on an opposite side of the body 26 (see FIG. 5) such that the openings 52, 54 are diametrically opposed to the openings 48, 50, respectively (see FIGS. 3 and 4). The openings 48, 50, as well as the openings 52, 54, are sized and shaped so as to permit the insertion of the user's finger through a sidewall 55 (see FIG. 5) of the body 26 for a purpose to be described hereinafter. The sidewall 55 has a long face 55*a* and a short face 55*b*, the openings 48, 50, 52, 54 being located intermediate the long and short faces 55*a*, 55*b*. Of course, the body 26 need not contain any openings whatsoever, or may contain such openings solely in the neck section 16 or base section 14. In embodiments where such openings are included in one or more sections of the body 26, the size and shape of the openings 48, 50, 52, 54, as well as their number and location, could be varied as will be evident from the following discussion. It should also be understood that a user's finger could be inserted into the interior of the base section 14 through the untruncated end 28 of the body 26.

Figure 36:
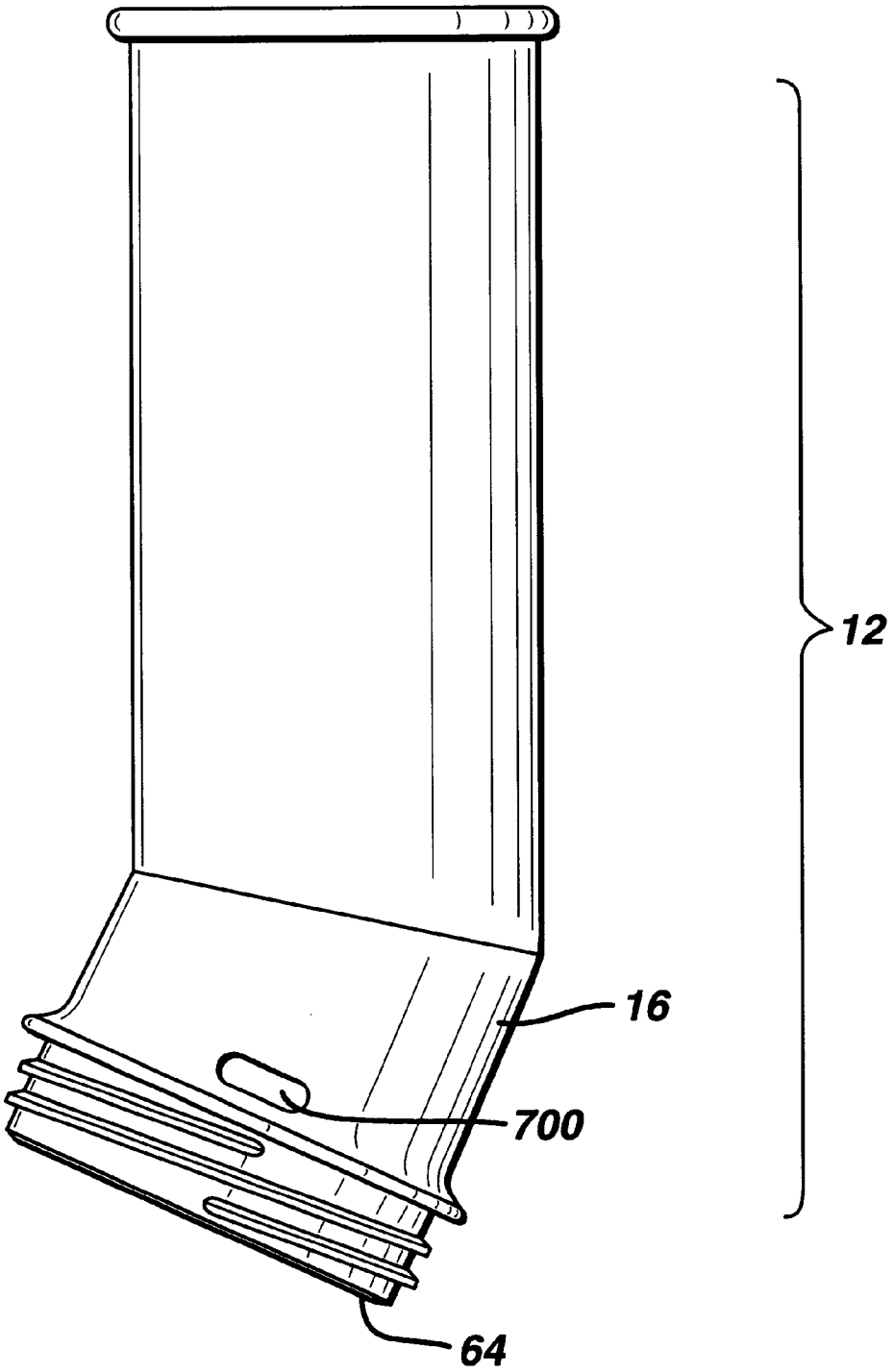
FIG. 36 is a side elevational view of a holder constructed in accordance with an alternative embodiment of the present invention having one small opening near the top open end, and having a relatively elongated base portion.

As shown in FIG. 36, openings 700 are preferably located in the neck section 16 near the open end 64 of the holder 12. The size of the openings are not critical; however it is preferred that the diameter of the openings be greater than about 0.030 inches to prevent: clogging of the venting opening and no larger than about 0.5 inches to prevent the infant from accessing the liner held therein. When the holder 12 is placed into warm water for heating the nutriment contained in the liner 18 held therein, these openings 700 permit the water to access the neck section 16 of the nurser and thus prevent the creation of an air lock that would otherwise preclude the water from accessing the exterior of the liner 18 at this neck section 16. As a result, there is an improved heat distribution within the liner 18.

Figure 3:
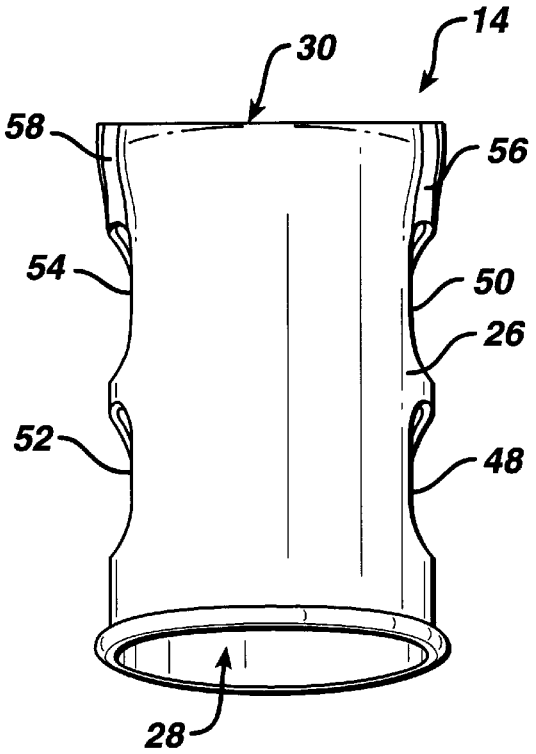
FIG. 3 is a perspective view taken from another side of the body section illustrated in FIG. 2.
Figure 4:
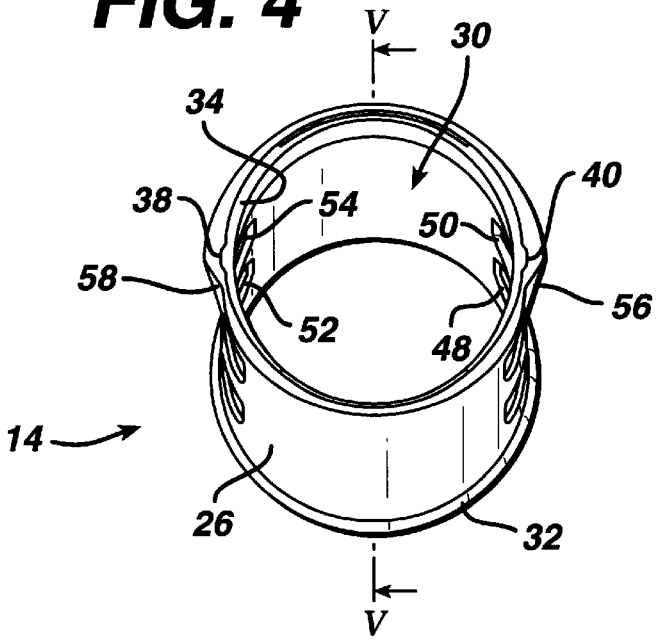
FIG. 4 is a top perspective view of the body section illustrated in FIG. 3.

In a preferred embodiment and as best shown in FIGS. 2–4, the base section 14 has contoured portions 56, 58 located on opposite sides of the body 26 and extending from the truncated end 30 to the openings 50, 54, respectively. The contour of each of the portions 56, 58 is specifically selected for a purpose to be described hereinafter.

With reference now to FIGS. 8–13, the neck section 16 of the holder 12 has a tubular body 60 which is preferably injection molded from a clear, translucent or colored plastic, such as polycarbonate or clarified polypropylene, a premixture of an olefin plastic (e.g. polypropylene) with a rubber (e.g., those available under the tradename "KRATON"), rubber alone, or any other suitable material known to those skilled in the art. As used herein, "tubular" body is not limited to circular cross-sectional shapes, but rather could include cross-sections having a varied of geomteric shapes, i.e. squares, triangles, elliptical, oval, and the like. The body 60 could be in the form of a bi-component or multi-component part made from more than one material, such as a combination of a polymer and a rubber. Such parts are conventionally manufactured by co-extrusion, co-molding, co-injection or other suitable technologies, such as an insert molding process, that incorporate the use of materials of different types and properties (see, for instance, U.S. Pat. No. 5,544,766). Alternatively, the body 60 could be made from glass.

Figure 11:
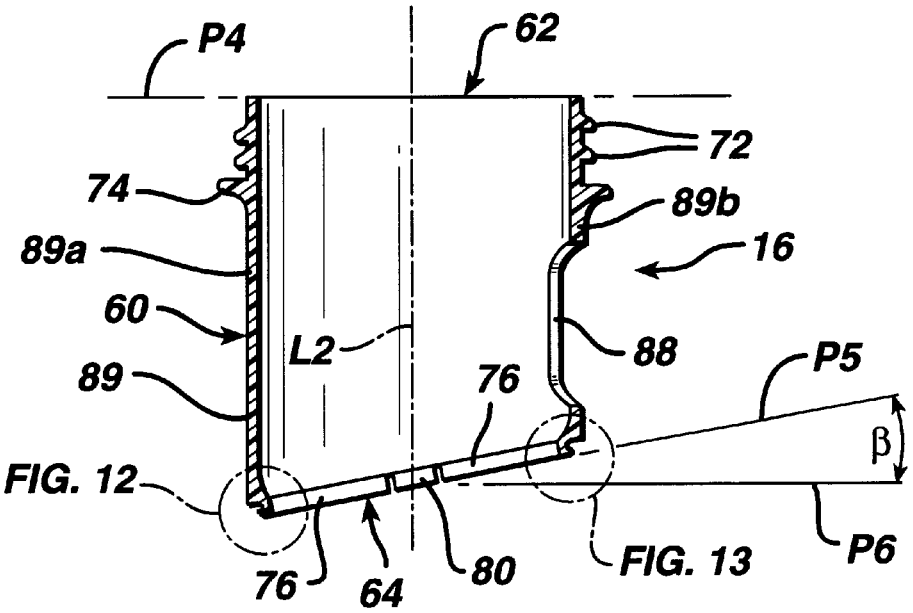
FIG. 11 is a cross-sectional view, taken along section line XI—XI of FIG. 10 and looking in the direction of the arrows, of the body section illustrated in FIG. 10.
Figure 12:
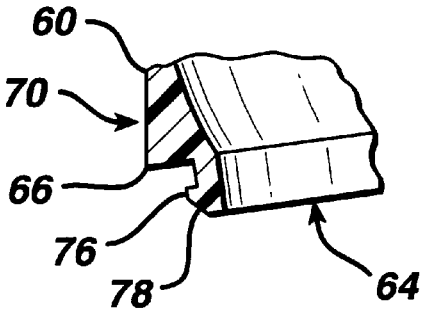
FIG. 12 is a detailed view, in an enlarged scale, of a portion of the body section illustrated in FIG. 11.
Figure 13:
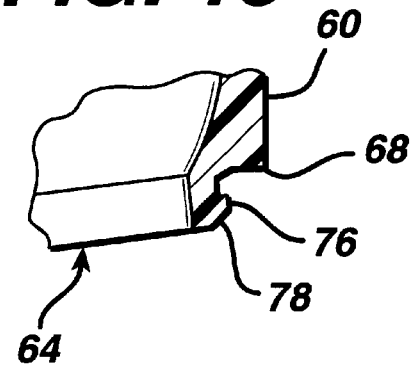
FIG. 13 is a detailed view, in an enlarged scale, of another portion of the body section illustrated in FIG. 11.
Figure 15:
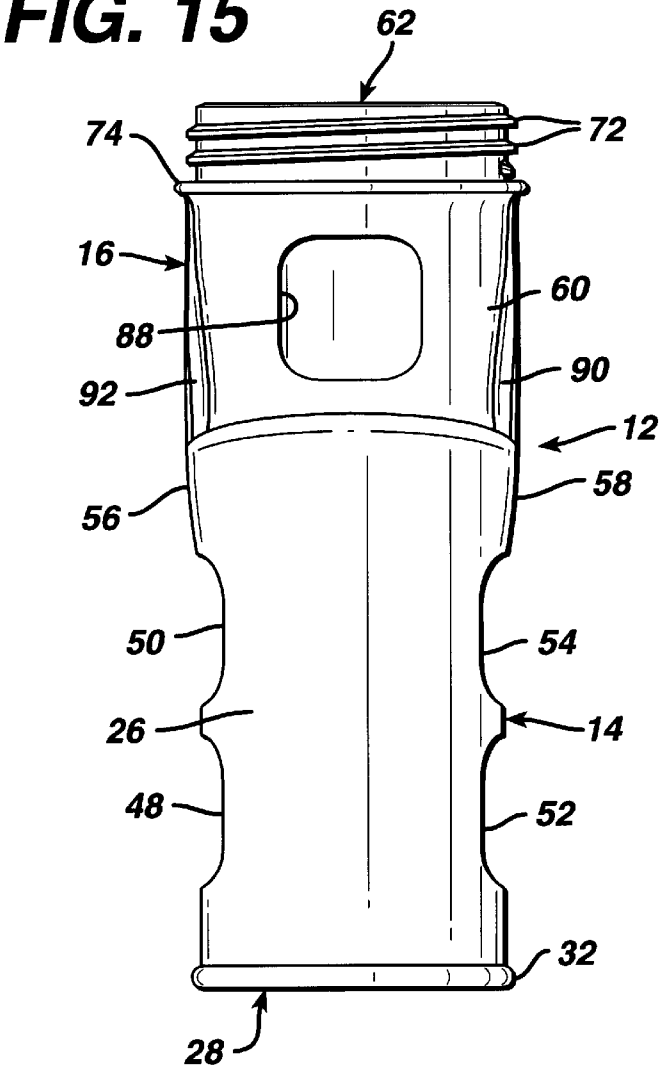
FIG. 15 is another side elevational view of the holder illustrated in FIG. 14.

The body 60, which has a truncated cylindrical shape, is hollow and terminates in a pair of open ends 62, 64. With particular reference to FIG. 11, the untruncated end 62 lies in an imaginary plane P4, which is normal to a longitudinal axis L2 of the neck section 16, while the truncated end 64 lies in an imaginary plane P5, which is arranged at an angle relative to an imaginary plane P6 parallel to the plane P4 and containing the point of intersection between the longitudinal axis L2 and the plane P5. The angle $\beta$ is substantially equal to the angle $\alpha$ described above; and, therefore, it is preferably about 12.5°, but can be anywhere in a preferred range of from about 5° to about 15° or in a more preferred range of from about 10° to about 15°. In theory, the angle $\beta$, like the angle $\alpha$, should be greater than 0°, but less than 45°. The significance of and the criteria for selecting these angles will be discussed hereinafter.

Due to the angle $\beta$, the truncated end 64 of the body 60 has a point 66 (see FIGS. 8 and 12), which is farthest from the untruncated end 62 of the body 60, and a point 68 (see FIGS. 8 and 13), which is nearest to the untruncated end 62 of the body 60. Also, the truncated end 64 of the body 60 has a slightly curved region 70 (see FIGS. 8 and 12), which extends around the body 60 in a generally semi-circular fashion from the point 66 toward the point 68 for a purpose to be described hereinafter.

The untruncated end 62 of the neck section 16 is provided with a series of external threads 72 adapted to threadedly mate with internal threads (not shown) provided on the collar 18. A° circular rim 74 extends outwardly from the body 60 far enough so that its diameter is substantially the same as the outer diameter of the collar 18, thereby providing a smooth, edge-free transition from the holder 12 to the collar 18.

The truncated end 64 of the neck section 16 is provided with a pair of semi-circular rings 76, each of which is adapted to ride, in a sliding manner, within the groove 34 of the base section 14, whereby the neck section 16 can be rotated relative to the base section 14 in a manner to be described in greater detail hereinafter. The rings 76 have sufficient inherent resiliency to permit them to be snap fitted into the groove 34 of the base section 14. To facilitate their insertion, each of the rings 76 has a beveled edge 78 (see FIGS. 11–13). In a preferred embodiment, the rings 76 are separated by a pair of tabs 80, 82, each of which slidably rides in the groove 34 of the base section 14. In a preferred embodiment, the tabs 80, 82 are arranged on opposite sides of the neck section 16 such that when one is aligned with the slot 38 of the base section 14, the other is aligned with the slot 40 of the base section 14 and vice versa.

Like the rings 76, the tabs 80, 82 have sufficient inherent resiliency to permit them to be snap fitted into the groove 34 of the base section 14, where they can ride in a sliding manner similar to the rings 76. However, unlike the rings 76, the tabs 80, 82 include outwardly projecting knobs 84, 86, respectively, which cooperate with the slots 38, 40 of the base section 14 to perform a detent function that will be described hereinafter. It should be understood that the number and location of the semi-circular rings 76 can be varied. Likewise, similar variations can be made in the tabs 80, 82. Thus, the tabs 80, 82 could be eliminated or their number could be increased or decreased independently of the number of slots 38, 40 employed. In other words, the slots 38, 40 and the tabs 80, 82 are optional elements having no set ratio therebetween. Therefore, it would be possible to place one or more tabs as well as one or more slots along various locations of neck section 14 in order to create intermittent locking devices necessary for enabling the body to adjust to various overall angled positions. Also, the dimensions of the tabs 80, 82, as well as the rings 76, could be varied as long as they are compatible with the dimensions of the groove 34 and the slots 38, 40. The snap-fit achieved by the groove 34, on the one hand, and the rings 76 and the tabs 80, 82, on the other hand, could be replaced by any other type of mechanical connection designed to achieve the desired relative rotation of the base section 14 and the neck section 16. An example of an alternative mechanical connection includes a friction fit mechanism such as that illustrated in FIG. 29.

Figure 29:
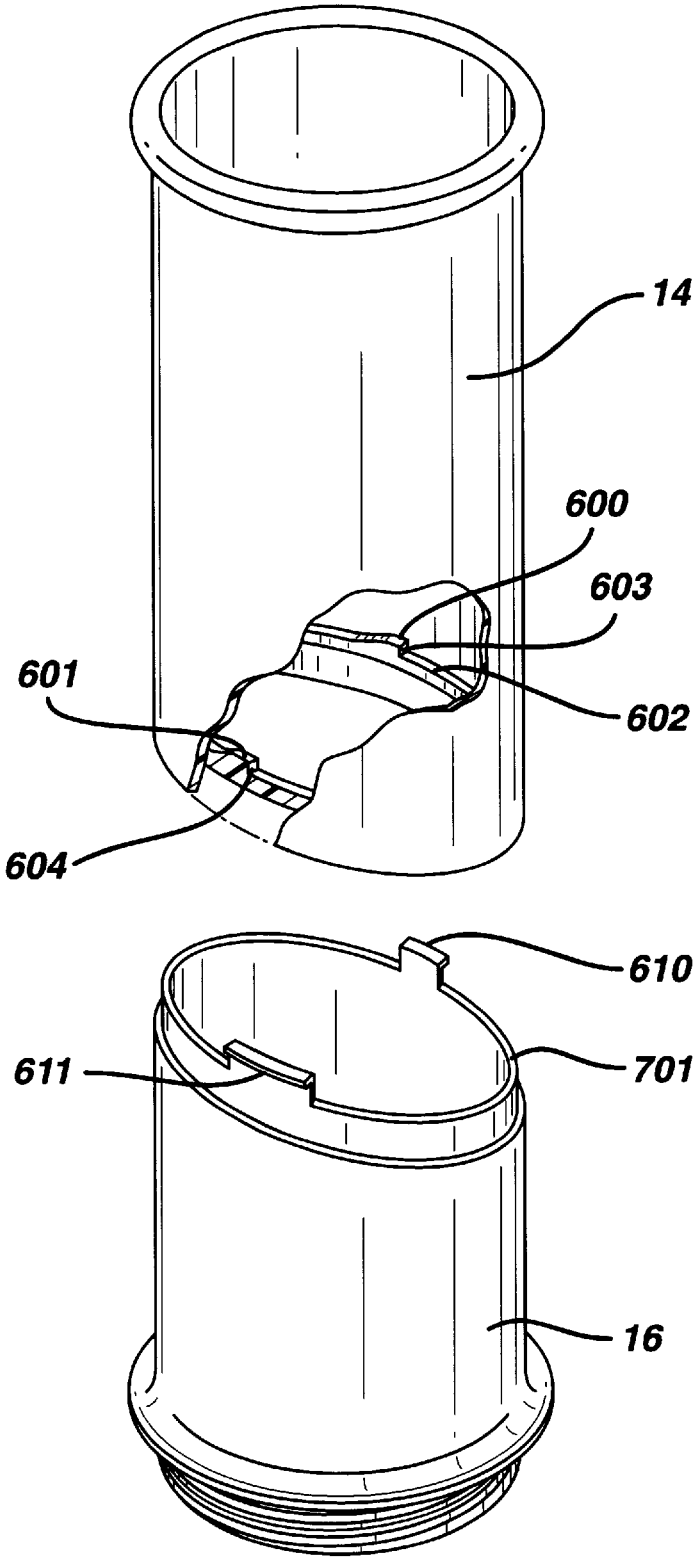
FIG. 29 is an exploded, perspective view of the neck portion and the base portion of the holder connected by a friction fit mechanism.

In the friction fit embodiment illustrated in FIG. 29, the base section possesses 2 ramping lugs 600, 601, while the neck section possesses two friction lugs 610, 611. In an alternative embodiment (not shown), the base section may possess the friction lugs 610, 611 while the neck section possesses the ramping lugs 600, 601. The ramping lugs are integral with the guiding ring 602, with each ramping lug extending under a portion of the circumference of the guiding ring 602. Preferably each ramping lug is located about 180 degrees apart from the other ramping lug. Similarly, each friction lug, which protrudes vertically away from the rim 701 of the base section, is located about 180 degrees apart from the other friction lug.

In a preferred embodiment as shown in FIG. 29, each ramping lug is formed by gradually thickening the guiding ring for a desired angle of curvature, which may range from about 5 to about 45 degrees. In an alternative embodiment, each ramping lug may be formed by a "bump" or any accumulation of material having a thickness, with shape not being critical. The height of the stop flap 603, 604 is not critical but preferably may range from about 0.005 inches to 0.5 inches.

Figure 30:
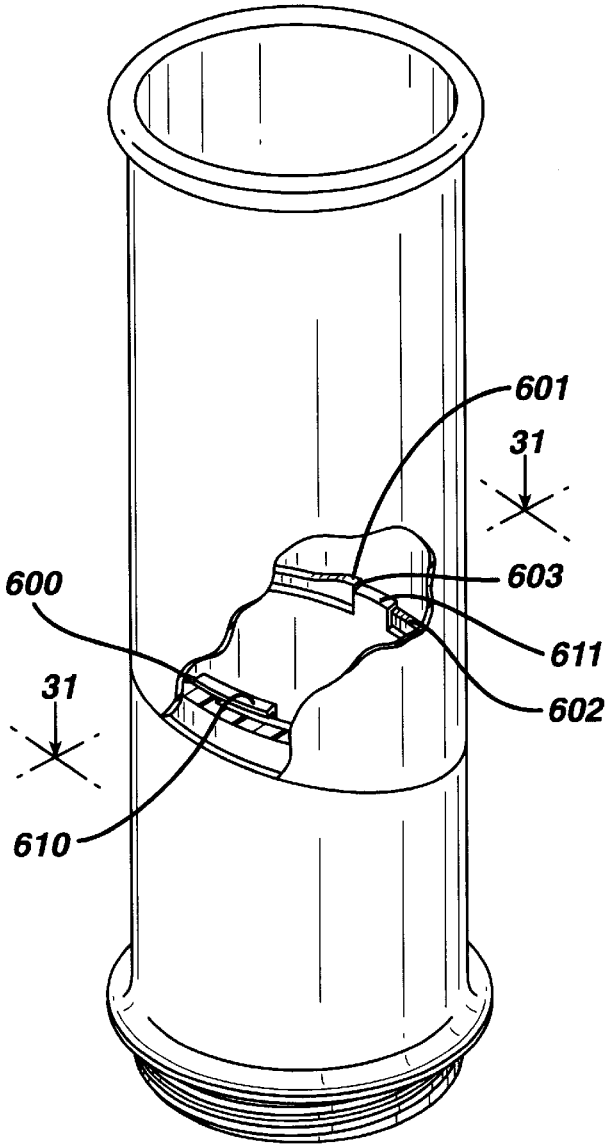
FIG. 30 is a perspective view of the holder illustrated in FIG. 29 shown in an assembled, vertical position.
Figure 31:
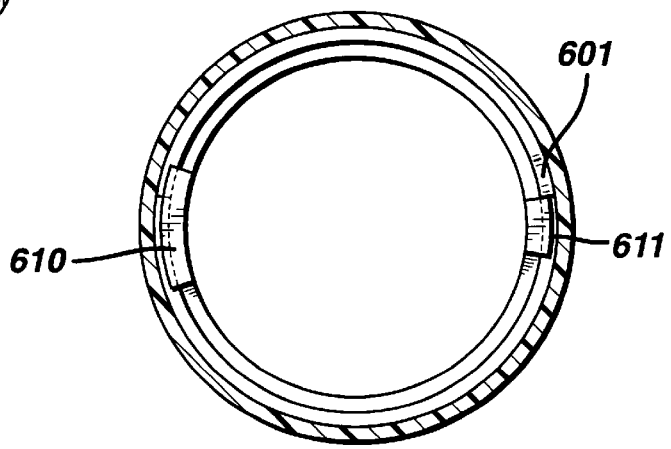
FIG. 31 is a transverse cross-sectional view of the holder illustrated in FIG. 30 taken along section line 31—31 of FIG. 30.

The neck section possesses two friction lugs 610, 611 which engage the guiding ring 602 for purposes of interlocking the neck section with the base section in an initially friction-free format. As the neck section is rotated up to 180 degrees relative to the base section, the friction lug 610 then frictionally engages the ramping lug 600, while simultaneously the other frictional lug 611 contacts the stop flap 603 of the ramping lug 601 in order to prevent overrotation of the neck section relative to the base section. The resulting configuration of the holder is in the vertical, or "filling" position as shown in FIG. 30.

Figure 32:
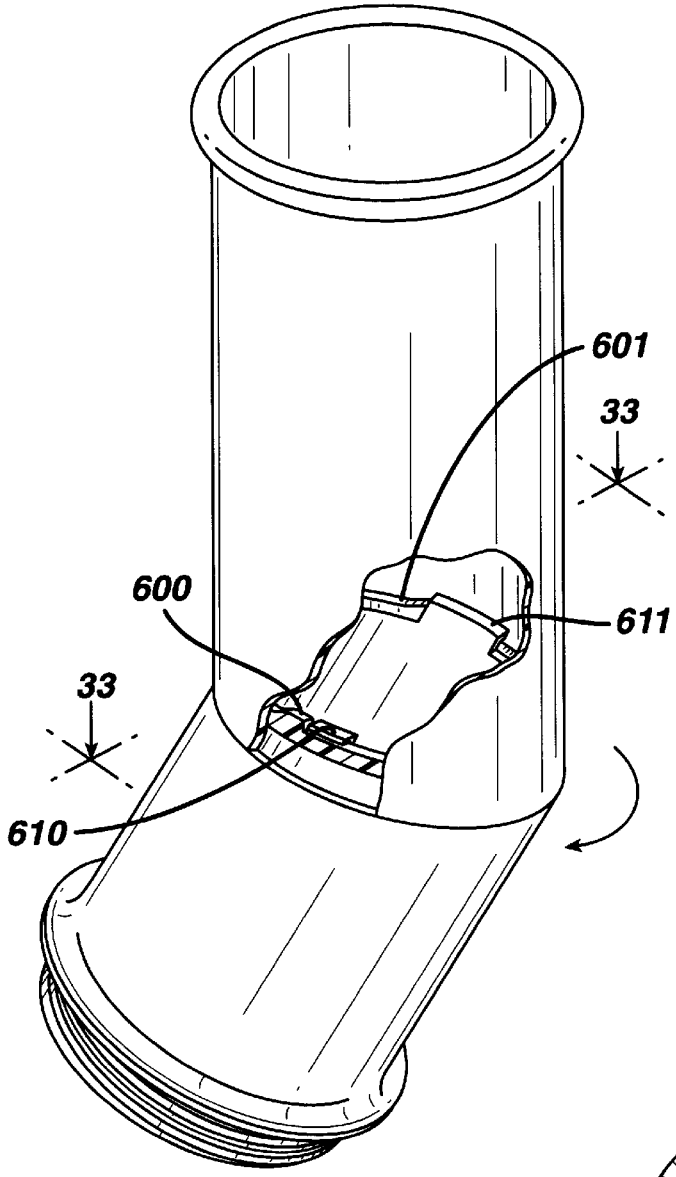
FIG. 32 is a perspective view of the holder illustrated in FIG. 29 shown in an assembled angled position.
Figure 33:
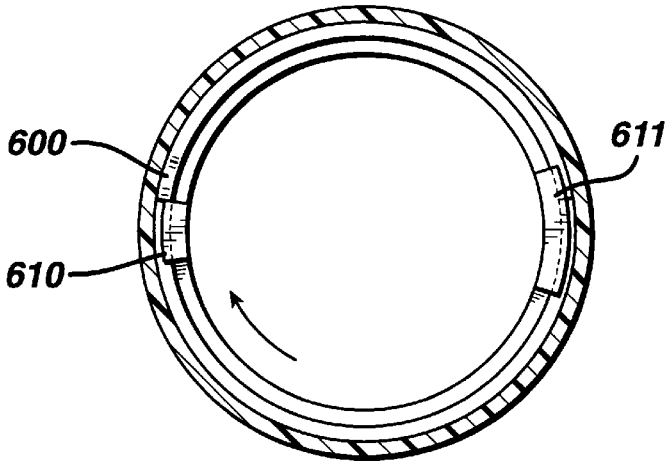
FIG. 33 is a transverse cross-sectional view of the holder illustrated in FIG. 32 taken along section line 33—33 of FIG. 32.

As shown in FIG. 32, the holder may be transformed from the vertical position to an angled position by rotating the neck section up to 180 degrees in the opposite direction used to achieve the vertical position.

In an alternative embodiment (not shown), the guiding ring may be replaced with a groove, with each ramping lug integral therein for purposes of achieving the same friction-fit property described above.

In a preferred embodiment, an opening 88 is provided on one side of the body 60. The opening 88 is sized and shaped so as to permit the insertion of a user's finger through a sidewall 89 (see FIG. 11) of the body 60 for a purpose to be described hereinafter. The sidewall 89 has a long face 89*a* and a short face 89*b*, the opening 88 being located in the short face 89*b*. Of course, the size and shape of the opening 88, as well as its number and location, could be varied as will be evident from the following discussion.

Figure 8:
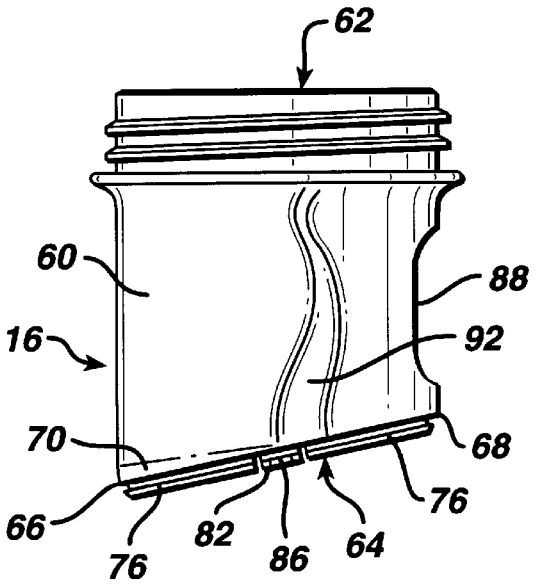
FIG. 8 is a side elevational view, in an enlarged scale, of the other body section which forms the holder illustrated in FIG. 1.
Figure 9:
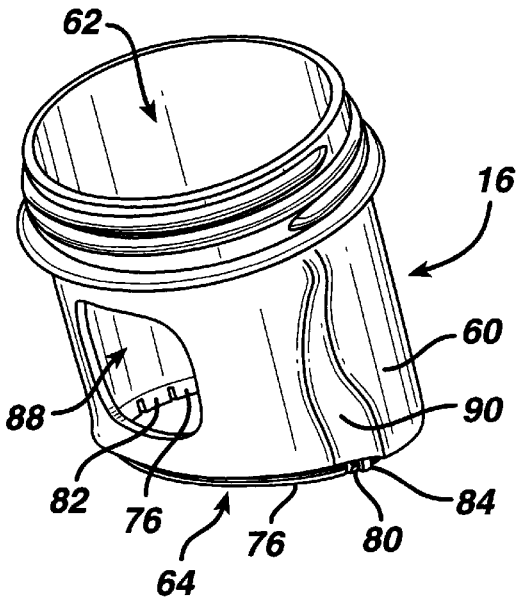
FIG. 9 is a perspective view of the body section illustrated in FIG. 8.
Figure 10:
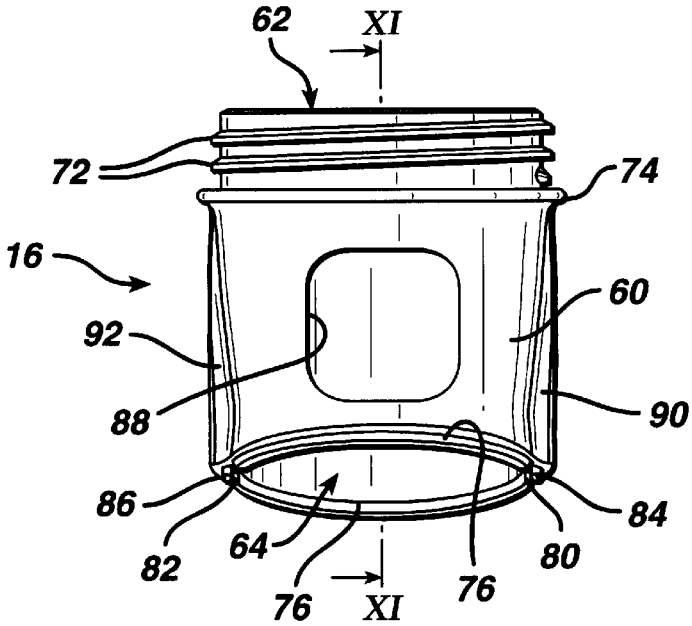
FIG. 10 is an elevational view taken from another side of the body section illustrated in FIG. 8.

In a preferred embodiment and as best shown in FIGS. 8–10, the neck section 16 has contoured portions 90, 92 located on opposite sides of the body 60. The contour of each of the portions 90, 92 is specifically selected for a purpose to be described hereinafter.

Figure 14:
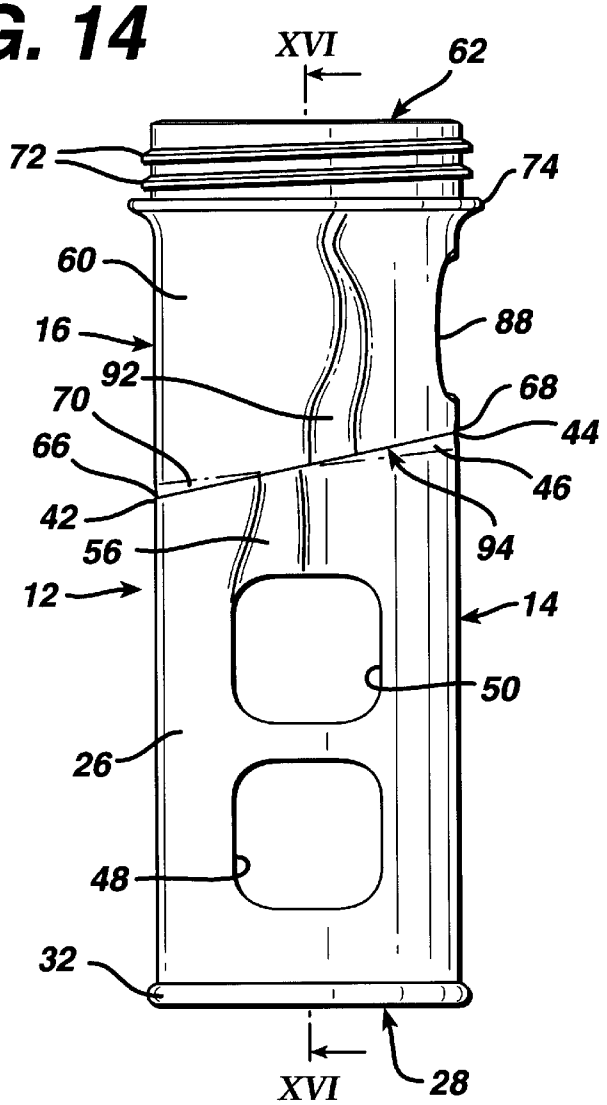
FIG. 14 is a side elevational view of the holder illustrated in FIG. 1, the holder being shown in an assembled state in its filling position.
Figure 16:
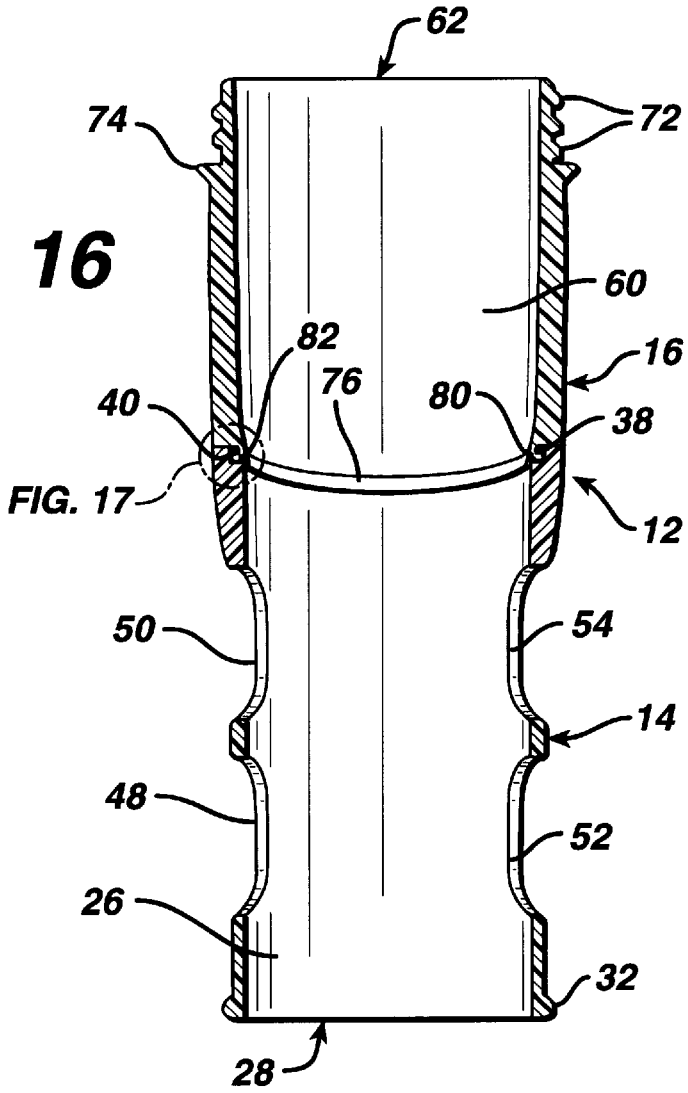
FIG. 16 is a cross-sectional view, taken along section line XVI—XVI of FIG. 14 and looking in the direction of the arrows, of the holder illustrated in FIG. 14.
Figure 17:
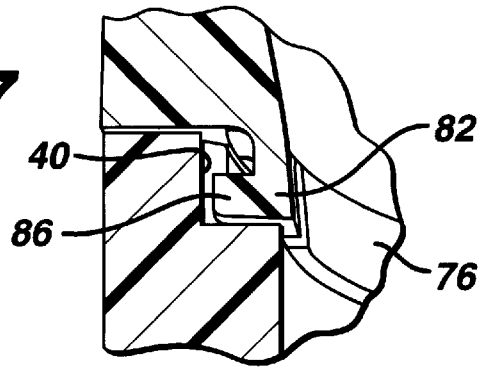
FIG. 17 is a detailed view, in an enlarged scale, of a portion of the holder illustrated in FIG. 16.

Referring now to FIGS. 14–17, the base section 14 and the neck section 16 are shown arranged in an abutting, end-to-end relationship with the truncated end 30 of the base section 14 interconnected to the truncated end 64 of the neck section 16, thereby resulting in the formation of a peripheral joint 94 which extends around the holder 12. More particularly, the semi-circular rings 76 and the tabs 80, 82 of the neck section 16 have been snap fitted into the groove 34 of the base section 14 with the tabs 80, 82 in releasable engagement with the slots 38, 40, respectively (see FIGS. 16 and 17). The knobs 84, 86 on the tabs 80, 82, respectively, cooperate with the slots 38, 40, respectively, to perform a detent function, whereby the base section 14 and the neck section 16 are releasably retained in the orientation shown in FIGS. 14–17 (i.e., an orientation, as best shown in FIG. 14, in which the point 42 on the base section 14 is aligned with the point 66 on the neck section 16 and the point 44 on the base section 14 is aligned with the point 68 on the neck section 16). When the base section 14 and the neck section 16 are so oriented, their longitudinal axes L1, L2, respectively, are arranged coaxially so that the holder is substantially straight or upright. In this position, which will be referred to hereinafter as the "filling position", the holder 12 facilitates the insertion of the liner 18, as well as its filling with a quantity of water, milk, flowable cereal or other liquid (hereinafter "nutriment"). When the holder 12 is in its filling position, the contoured portions 56, 58 of the base section 14 do not align with the contoured portions 90, 92 of the neck section 16 (see FIG. 14).

Figure 19:
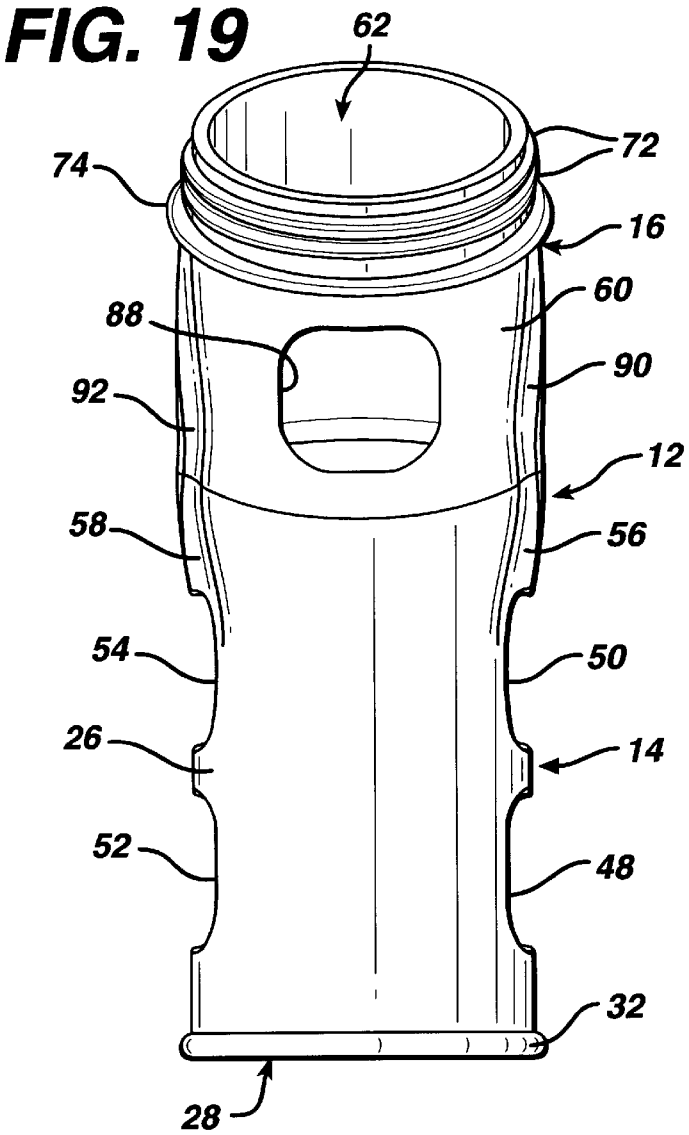
FIG. 19 is another side elevational view of the holder illustrated in FIG. 18.
Figure 18:
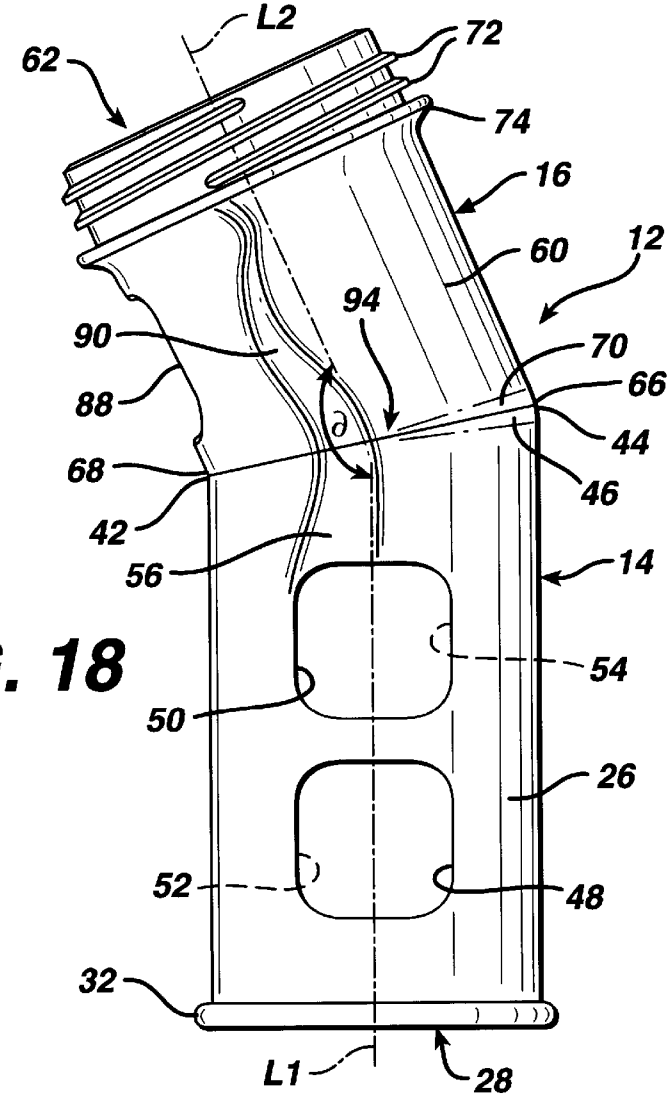
FIG. 18 is a side elevational view of the holder illustrated in FIG. 1, the holder being shown in an assembled state in its feeding position.
Figure 22:
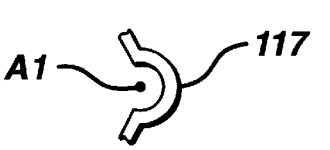
FIG. 22 is a detailed view, in an enlarged scale, of a portion of the holder illustrated in FIG. 21.

Because the base section 14 and the neck section 16 are rotatable relative to each other, the neck section 16 can be gripped and preferably rotated up to about 180° relative to the base section 14 to the position illustrated in FIGS. 18 and 19. In this position, which will be referred to hereinafter as the "feeding position", the longitudinal axes L1, L2 of the base section 14 and the neck section 16, respectively, are no longer coaxial, but rather assume a non-coaxial relationship that imparts an angular or bent shape to the holder 12. The angular relationship between the base section 14 and the neck section 16 is a function of the angles $\alpha$ and $\beta$. When, for instance, the angles $\alpha$ and $\beta$ are about 12.5°, the neck section 16 forms an angle $\partial$ (see FIG. 18) of about 167.5° (as measured between the longitudinal axes L1 and L2 of FIG. 18) with the base section 14. However, this angle $\partial$ can be anywhere in a preferred range of from about 165° to about 175° or a more preferred range of from about 170° to about 175°. In theory, the angle should be greater than 135°, but less than 180°. When the holder 12 is in its preferred feeding position, the contoured portions 56, 58 of the base section 14 are aligned with the contoured portions 90, 92, respectively, of the neck section 16 to form finger guides or rests which facilitate the proper positioning of a user's hand on the holder 12 (see FIG. 18).

In moving or transforming the holder 12 from the filling position illustrated in FIGS. 14–17 to the feeding position illustrated in FIGS. 18 and 19, the neck section 16 is preferably rotated up to about 180° relative to the base section 14 in either a clockwise or counterclockwise direction. During this rotation, the tab 80 on the neck portion 16 is moved out of engagement with the slot 38 in the base section 14 and into engagement with the slot 40 in the base section 14, while the tab 82 on the neck portion 16 is moved out of engagement with the slot 40 and into engagement with the slot 38. The knobs 84, 86 on the tabs 80, 82, respectively, now cooperate with the slots 40, 38, respectively, to perform a detent function, whereby the base section 14 and the neck section 16 are releasably retained in the orientation shown in FIGS. 18 and 19 (i.e., an orientation, as best shown in FIG. 18, in which the point 42 on the base section 14 is aligned with the point 68 on the neck section 16 and the point 44 on the base section 14 is aligned with the point 66 on the neck section 16). When the base section 14 and the neck section 16 are so oriented, the curved region 46 of the base section 14 merges with the curved region 70 of the neck section 16 to form a smooth bend in the holder 12 at the resulting junction between the base section 14 and the neck section 16 (see FIG. 18). It should also be noted that, when the base section 14 and the neck section 16 are oriented as shown in FIGS. 18 and 19, the opening 88 in the neck section 16 faces the user or nurser to make it more accessible for a purpose to be described hereinafter.

In use, the holder 12 would be initially arranged in the filling position of FIGS. 14–17 to permit the easy insertion of the liner 18, which can be of a conventional flat-bag type or a conventional drop-in bag type. After the liner 18 is filled with a quantity of nutriment, the nipple 20 and the collar 22 would be applied to the holder 12 in a conventional manner. If feeding is not imminent, then the cap 24 would also be applied in accordance with conventional practice. In preparation for feeding an infant or the like, an adult or other user (i.e., nurser) may insert his or her finger into the openings 48, 50, 52, 54 in the body 26 of the base section 14 for the purpose of expelling air from the filled or partially filled liner 18.

To perform a feeding operation, the holder 12 would be moved or transformed into the feeding position of FIGS. 18 and 19. The inherent flexibility of the liner 18 would allow it to assume a position or shape similar to that of the holder 12. With the user's fingers resting comfortably in the finger guides formed by the contiguously aligned contoured portions 56, 90, on one side of the holder 12, and the contiguously aligned contoured portions 58, 92, on the other side of the holder 12, the holder 12 would be arranged relative to the infant such that the opening 88 in the neck section 16 faces away from the infant or toward the user. As nutriment is dispensed from the liner 18, the user can expel air from the liner 18 by inserting his or her fingers through one or more of the openings 48, 50, 52, 54 in the base section 14. In a similar manner, the opening 88 in the neck section 16 can be used to expel air from the liner 18 when the liner 18 is almost completely empty, whereby the expulsion of air can take place throughout substantially the entire feeding process.

At the conclusion of a feeding operation, the holder 12 would be returned to the filling position of FIGS. 14–17. If the liner 18 still contains nutriment, the cap 24 could be applied and the nurser system 10 could be stored with the holder 12 in the feeding, or upright, position. If the liner 18 is empty, then it could be removed and disposed of after detaching the collar 22 and removing the nipple 20 from the holder 12.

Three other exemplary embodiments of a holder constructed in accordance with the present invention are illustrated in FIGS. 20–22, FIGS. 24–27 and FIG. 28, respectively. Elements illustrated in FIGS. 20–22, FIGS. 24–27 and FIG. 28 which correspond to the elements described above with respect to FIGS. 1–19 have been designated by corresponding reference numerals increased by one hundred, two hundred and three hundred, respectively. The embodiments of FIGS. 20–28 are designed for use in the same manner as the embodiment of FIGS. 1–19 unless otherwise stated.

Referring to FIGS. 20–23, a holder 112 includes a base section 114 and a neck section 116 which are pivotally connected to each other by a living (i.e., molded in) hinge 117 (see FIG. 22) formed integrally therewith, whereby the holder 112 has a one-piece or unitary construction. The living hinge 117 allows the neck section 116 to pivot relative to the base section 114 about a transverse pivot axis A1 (see FIG. 22), which extends tangentially relative to the holder 112. More particularly, the neck section 116 pivots about the pivot axis A1 between the filling position of FIGS. 20 and 21 and a feeding position similar to that depicted in FIG. 18.

Figure 23:
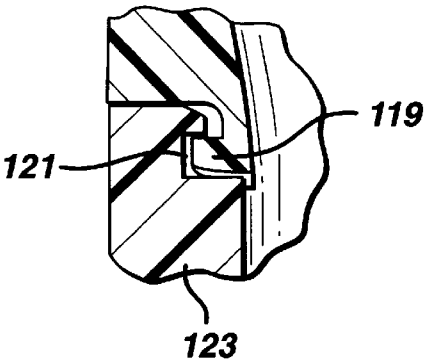
FIG. 23 is a detailed view, in an enlarged scale, of another portion of the holder illustrated in FIGS. 20 and 21 when the holder is in its feeding position.
Figure 21:
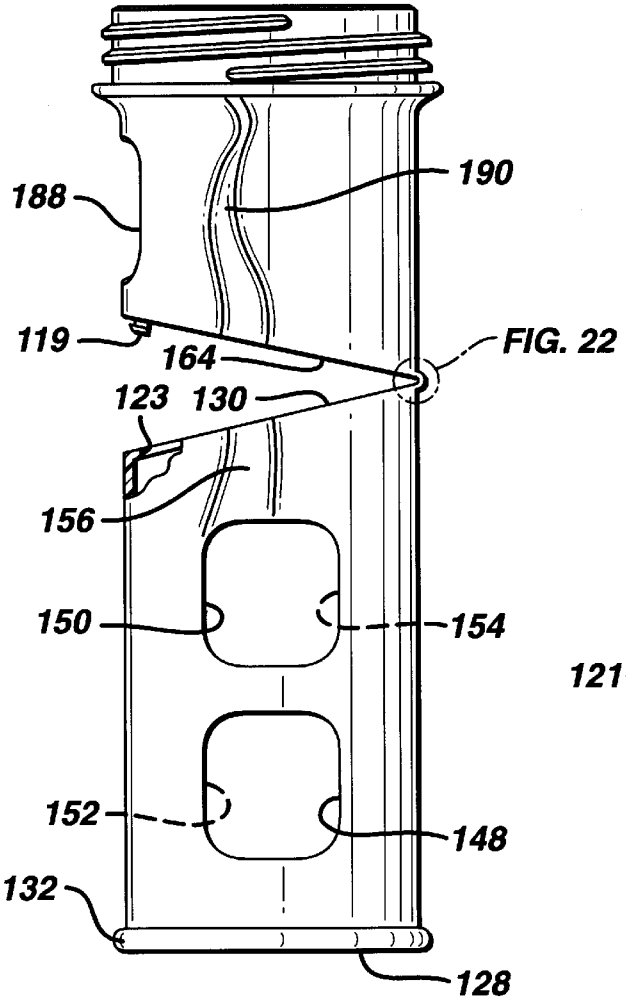
FIG. 21 is an elevational view taken from another side of the holder illustrated in FIG. 20, a portion of the holder being broken away to reveal internal structure.
Figure 20:
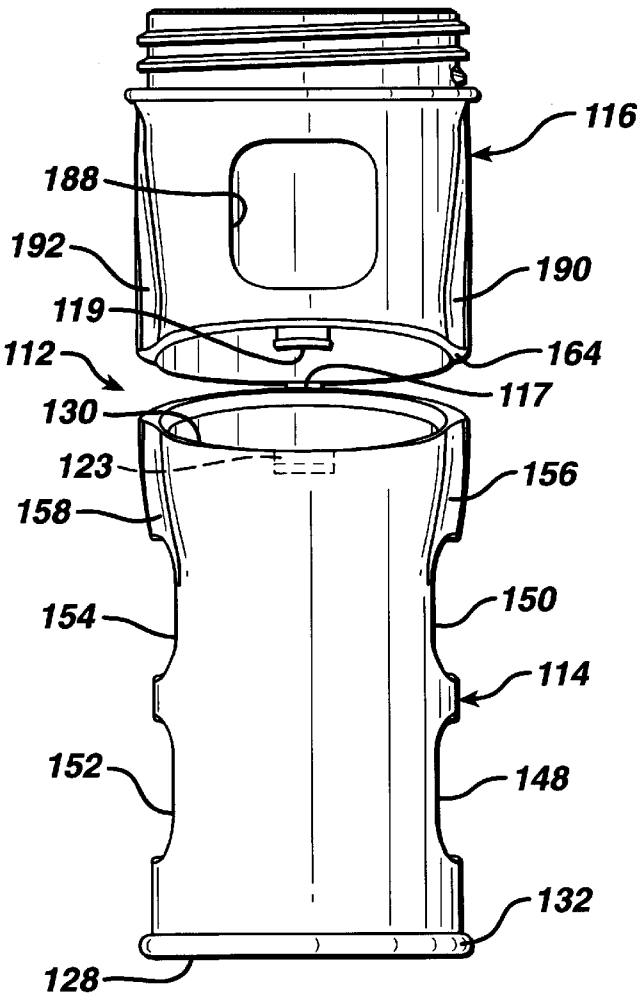
FIG. 20 is a side elevational view of a holder constructed in accordance with a second exemplary embodiment of the present invention, the holder being shown in its filling position.

A clip 119 depending from a truncated end 164 of the neck section 116 releasably engages a notch 121 (see FIG. 23) in a lip 123 formed on a truncated end 130 of the base section 114 to releasably retain the neck section 116 in its feeding position (see FIG. 23). The clip 119 and the lip 121 could be replaced by other suitable detent members adapted to cooperate for the purpose of releasably retaining the neck section 116 in its feeding position.

Except for the mechanism employed to interconnect the base section 114 and the neck section 116, the holder 112 is otherwise equipped with most, if not all, of the various additional features of the previous embodiments. For instance, the base section 114 has an open end 128 provided with a bead 132, as well as a plurality of access openings 148, 150, 152, 154. Contoured portions 156, 158 on the base section 114 are alignable with contoured portions 190, 192, respectively, on the neck section 116, which also includes an access opening 188.

Figure 26:
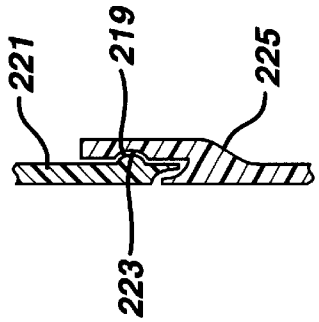
FIG. 26 is a detailed view, in an enlarged scale and taken along the section line XXVI—XXVI, of a portion of the holder illustrated in FIG. 25.

With reference now to FIGS. 24–27, a holder 212 includes a base section 214 and a neck section 216 which are pivotally connected to each other by a pair of ball and socket type connectors 217 arranged on diametrically opposed sides of the holder 212. As shown in FIG. 26, each of the ball and socket type connectors 217 includes a spherical nub 219 on an ear 221 which depends from a truncated end 264 of the neck section 216, as well as a spherical depression 223 in an ear 225 which extends from a truncated end 230 of the base section 214.

The spherical nub 219 is pivotally received in the spherical depression 223 such that the ball and socket type connectors 217 allow the neck section 216 to pivot relative to the base section 214 about a transverse pivot axis A2 (see FIG. 25), which extends diametrically through the holder 212. More particularly, the neck section 216 pivots about the pivot axis A2 between the filling position of FIGS. 24 and 25 and a feeding position similar to that depicted in FIG. 18.

Figure 27:
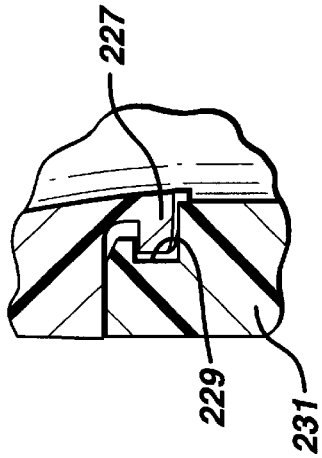
FIG. 27 is a detailed view, in an enlarged scale, of another portion of the holder illustrated in FIGS. 24 and 25 when the holder is in its feeding position.
Figure 25:
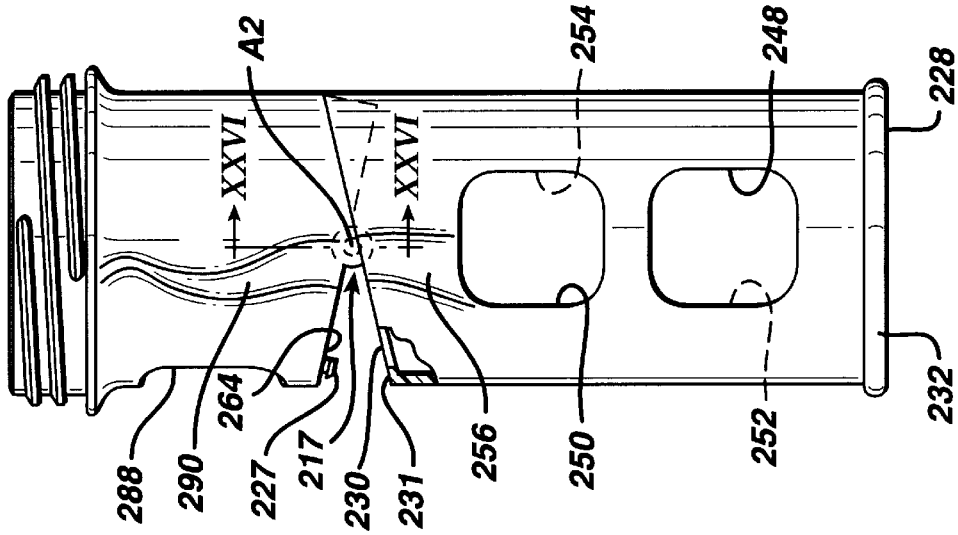
FIG. 25 is an elevational view taken from another side of the holder illustrated in FIG. 24, a portion of the holder being broken away to reveal internal structure.
Figure 24:
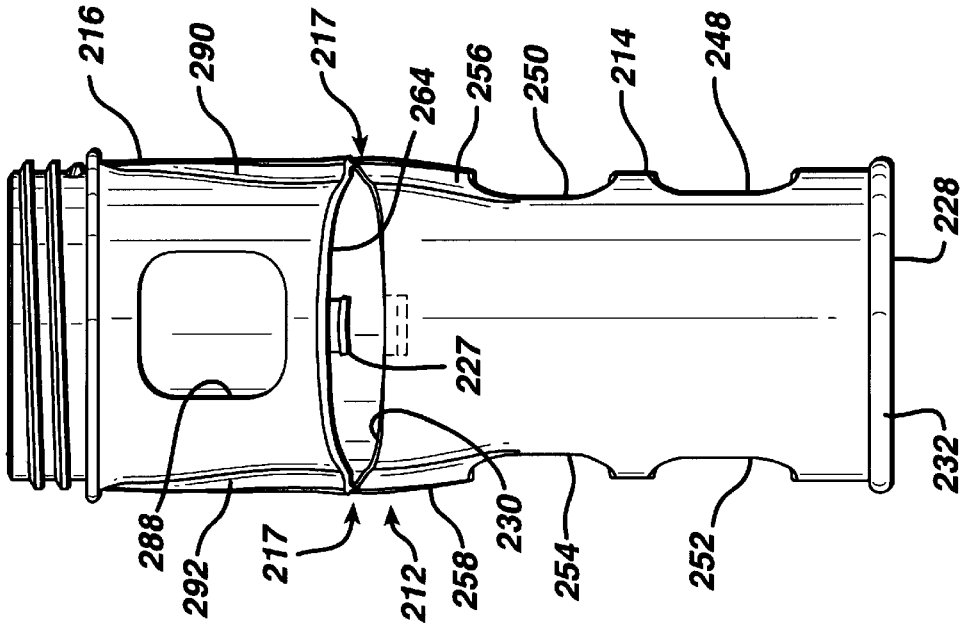
FIG. 24 is a side elevational view of a holder constructed in accordance with a third exemplary embodiment of the present invention, the holder being shown in its filling position.

A clip 227 depending from the truncated end 264 of the neck section 216 releasably engages a notch 229 (see FIG. 27) in a lip 231 formed on the truncated end 230 of the base section 214 to releasably retain the neck section 216 in its feeding position (see FIG. 27). The clip 227 and the lip 231 could be replaced by other suitable detent members adapted to cooperate for the purpose of releasably retaining the neck section 216 in its feeding position.

Except for the mechanism employed to interconnect the base section 214 and the neck section 216, the holder 212 is otherwise equipped with most, if not all, of the various additional features of the previous embodiments. For instance, the base section 214 has an open end 228 provided with a bead 232, as well as a plurality of access openings 248, 250, 252, 254. Contoured portions 256, 258 on the base section 214 are alignable with contoured portions 290, 292, respectively, on the neck section 216, which also includes an access opening 288.

Figure 28:
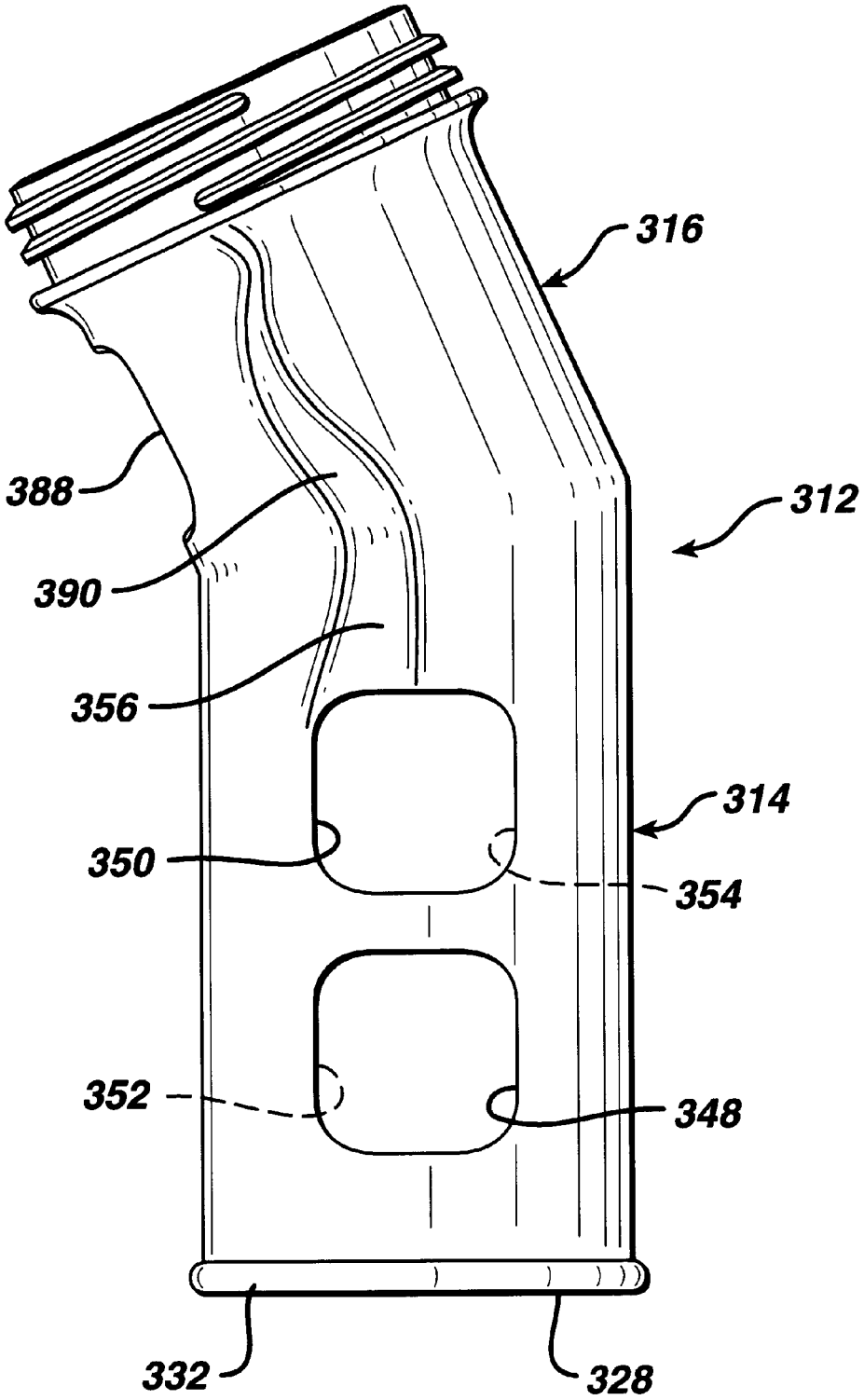
FIG. 28 is a side elevational view of a holder constructed in accordance with a fourth exemplary embodiment of the present invention.

Referring to FIG. 28, a holder 312 includes a base section 314 and a neck section 316 which are rigidly connected to each other, whereby the holder 312 has not only a unitary construction but also a fixed angular shape. That is, the holder 312 is not transformable like the previous embodiments. Except for its inability to be moved out of the feeding position illustrated in FIG. 28, the holder 312 is otherwise equipped with most, if not all, of the various additional features of the previous embodiments. For instance, the base section 316 has an open end 328 provided with a bead 332, as well as a plurality of access openings 348, 350, 352, 354. Contoured portions 356, 358 (only contoured portion 356 being visible in FIG. 28) on the base section 314 merge with contoured portions 390, 392 (only contoured portion 390 being visible in FIG. 28), respectively, on the neck section 316, which also includes an access opening 388. In an alternate embodiment, the base section 314 and the neck section 316 could be flexibly connected to each other by, for instance, bellows or any other suitable mechanism which would permit relative movement between the base section 314 and the neck section 316. While it may not be practical to equip such an alternate embodiment with all of the foregoing features, it is contemplated that this embodiment would be provided with the access opening 388.

Figure 35:
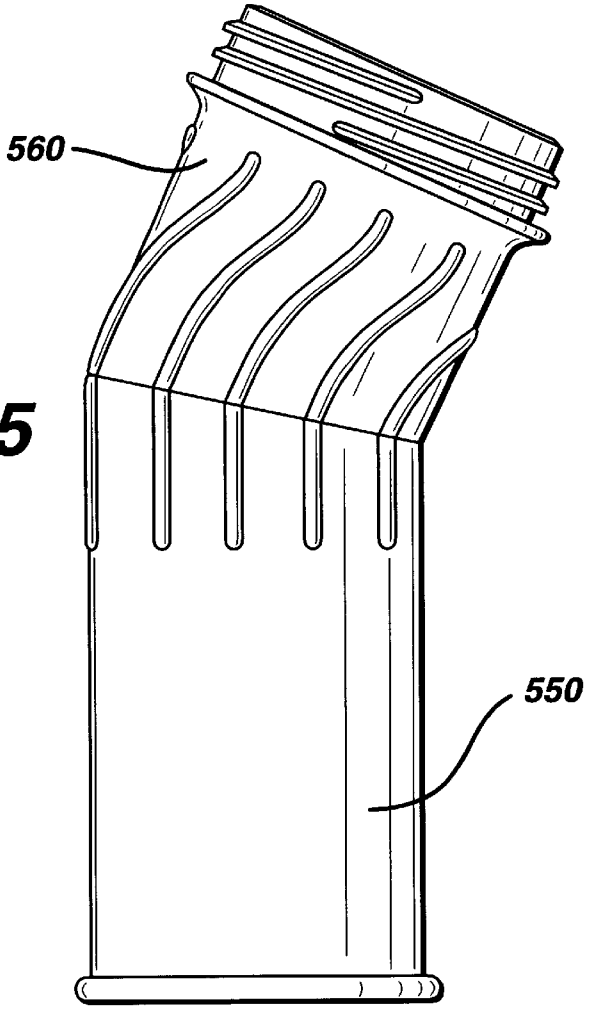
FIG. 35 is a side elevational view of a holder in an angled position having a plurality of contoured regions.
Figure 34:
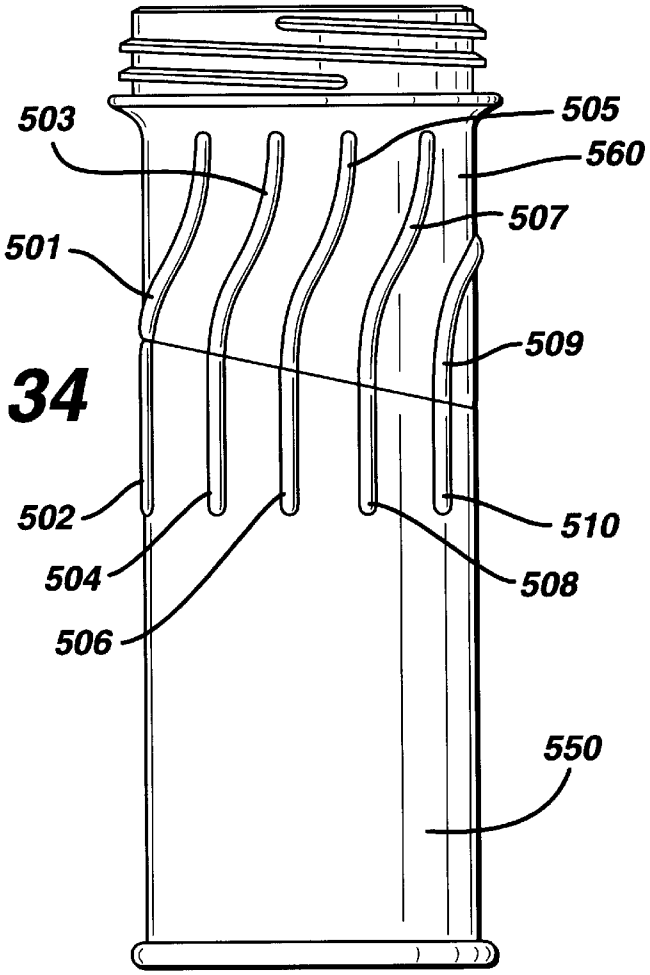
FIG. 34 is a side elevational view of a holder in a vertical position having a plurality of contoured regions.

As shown in FIGS. 34 and 35, the base section 550 may have a plurality of contoured portions 502, 504, 506, 508, 510 that are alignable with one or more contoured portions 501, 503, 505, 507, 509 on the neck section 560. This embodiment will provide improved finger guides or rests for proper positioning of a user's hand on the holder, regardless of whether the holder is used in a vertical position (FIG. 34), a maximum angled position (FIG. 35), or another intermediate position whereby the neck section 560 is rotated greater than 0° and less than 180° relative to the base section 550. It is not necessary to have each of the contoured portions of the neck section 560 aligned with a respective contoured portion of the base section 550.

It will be understood that the embodiments described herein are merely exemplary and that a person skilled in the art may make many variations and modifications without departing from the spirit and scope of the present invention. For instance, the size and shape of the holder's body may be varied to accommodate different size liners. Thus, the length and width of the body may be varied. It is also possible to make the holders from bodies having cross-sectional shapes other than cylindrical, such as square, triangular, hexagonal, etc. All such variations and modifications are intended to be included within the scope of the invention as defined in the appended claims.

We claim:

1. A transformable holder for use in disposable feeding systems, said holder comprising a first rigid body section having a first longitudinal axis and a first pair of open ends, a second rigid body section having a second longitudinal axis and a second pair of open ends, and connecting means for connecting one end of said first body section to one end of said second body section in a friction fit fashion, said connecting means comprising a first ramping lug, a second ramping lug, a first friction lug, and a second friction lug such that the first and second body sections are movable relative to each other between a first position in which said first and second longitudinal axes are in substantial coaxial alignment with each other, whereby said holder is substantially straight, and a second position, in which said one end of said first body section abuts said one end of said second body section and in which said first and second longitudinal axes are substantially out of coaxial alignment with each other, whereby said holder is substantially angled.

2. The transformable holder according to claim 1, wherein at least one of said ramping lugs has an angle of curvature of from about 5 degrees to about 45 degrees.

3. The transformable holder according to claim 1, wherein at least one of said ramping lugs has a stop flap having a height of about 0.005 inches to about 0.5 inches.

4. The transformable holder according to claim 1, wherein said first and second ramping lugs are integral with the first body section, and said first and second friction lugs are integral with the second body section.

5. The transformable holder according to claim 1, wherein said first and second ramping lugs are located on diametrically opposed portions of a guiding ring.

6. The transformable holder according to claim 1, wherein said first and second friction lugs are located on diametrically opposed portions of a rim of one of the body portions.

7. The transformable holder according to claim 1, wherein said first friction lug frictionally engages the first ramping lug when the first body portion is rotated up to about 180 degrees relative to the second body portion.

* * * * *